US006120255A

United States Patent [19]

Schumann et al.

[11] Patent Number: 6,120,255

[45] Date of Patent: Sep. 19, 2000

[54] SCROLL MACHINE WITH CAPACITY MODULATION

[75] Inventors: Stanley P. Schumann, Sidney; Donald R. Fiegel, New Knoxville; Jeffrey L. Berning, Fort Loramie, all of Ohio

[73] Assignee: Copeland Corporation, Sidney, Ohio

[21] Appl. No.: 09/007,972

[22] Filed: Jan. 16, 1998

[51] Int. Cl.[7] ..... F04B 49/06

[52] U.S. Cl. ..... 417/213; 417/440; 417/505

[58] Field of Search ..... 417/213, 440, 417/505

[56] References Cited

U.S. PATENT DOCUMENTS

| | | | |
|---|---|---|---|
| 4,383,805 | 5/1983 | Teegarden et al. . | |
| 4,441,863 | 4/1984 | Hotta et al. | 417/281 |
| 4,456,435 | 6/1984 | Hiraga et al. . | |
| 4,468,178 | 8/1984 | Hiraga et al. . | |
| 4,497,615 | 2/1985 | Griffith . | |
| 4,514,150 | 4/1985 | Hiraga et al. . | |
| 4,566,863 | 1/1986 | Goto et al. . | |
| 4,673,340 | 6/1987 | Mabe et al. . | |
| 4,747,756 | 5/1988 | Sato et al. . | |
| 4,767,293 | 8/1988 | Caillat et al. | 418/55 |
| 4,846,633 | 7/1989 | Suzuki et al. | 417/310 |
| 4,877,382 | 10/1989 | Caillat et al. | 418/55 |
| 4,992,033 | 2/1991 | Caillat et al. | 418/55.3 |
| 5,074,760 | 12/1991 | Hirooka et al. . | |
| 5,074,761 | 12/1991 | Hirooka et al. . | |
| 5,102,316 | 4/1992 | Caillat et al. | 418/55.5 |
| 5,192,195 | 3/1993 | Iio et al. . | |
| 5,336,058 | 8/1994 | Yokoyama | 417/299 |
| 5,407,335 | 4/1995 | Caillat et al. | 418/55.1 |
| 5,551,846 | 9/1996 | Taylor et al. . | |
| 5,562,426 | 10/1996 | Watanabe et al. . | |
| 5,591,014 | 1/1997 | Wallis et al. | 417/310 |
| 5,607,288 | 3/1997 | Wallis et al. | 417/310 |
| 5,613,841 | 3/1997 | Bass et al. | 417/310 |
| 5,678,985 | 10/1997 | Brooke et al. | 417/299 |
| 5,890,876 | 4/1999 | Suito et al. | 417/213 |

FOREIGN PATENT DOCUMENTS

| | | | |
|---|---|---|---|
| 59-211781 | 11/1984 | Japan | 417/505 |
| 3-202691 | 9/1991 | Japan . | |

*Primary Examiner*—Charles G. Freay
*Assistant Examiner*—David J. Torrente
*Attorney, Agent, or Firm*—Harness, Dickey & Pierce, P.L.C.

[57] ABSTRACT

An improved capacity modulation system for scroll-type compressors is disclosed in which a valve body of a solenoid valve assembly is secured to the inner wall of the hermetic shell and the actuating coil is mounted on the outer surface thereof. The actuating coil includes a plunger/valve member which cooperates with passages provided in the valve body to selectively actuate the capacity modulation arrangement utilizing compressed fluid. The construction offers the advantage that all fluid pressure lines are located within the hermetic shell and thus protected from potential damage, the solenoid coil may be easily changed/replaced to accommodate different available operating voltages and/or malfunction thereof and the system can be easily tested prior to final welding of the outer shell.

22 Claims, 6 Drawing Sheets

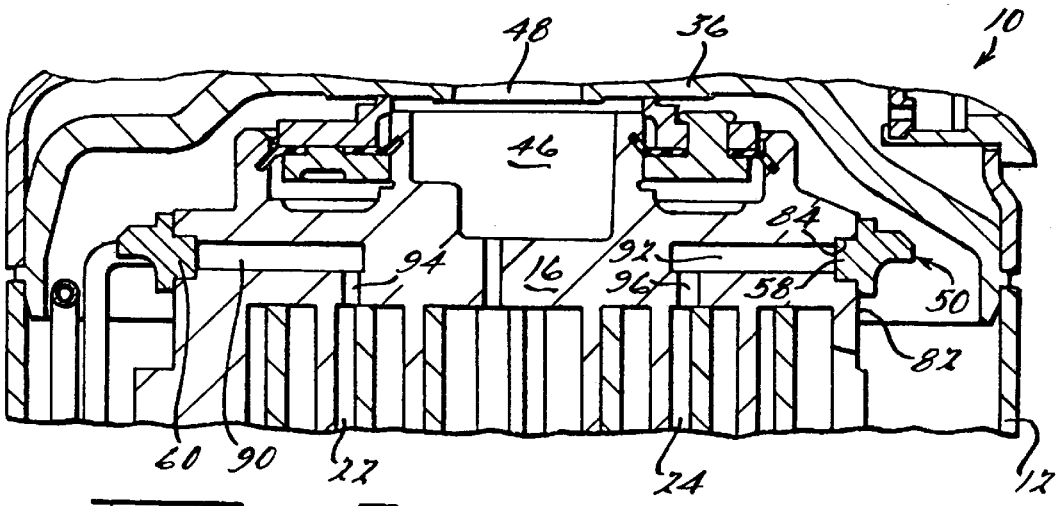
FIG. 2.
FIG. 3.
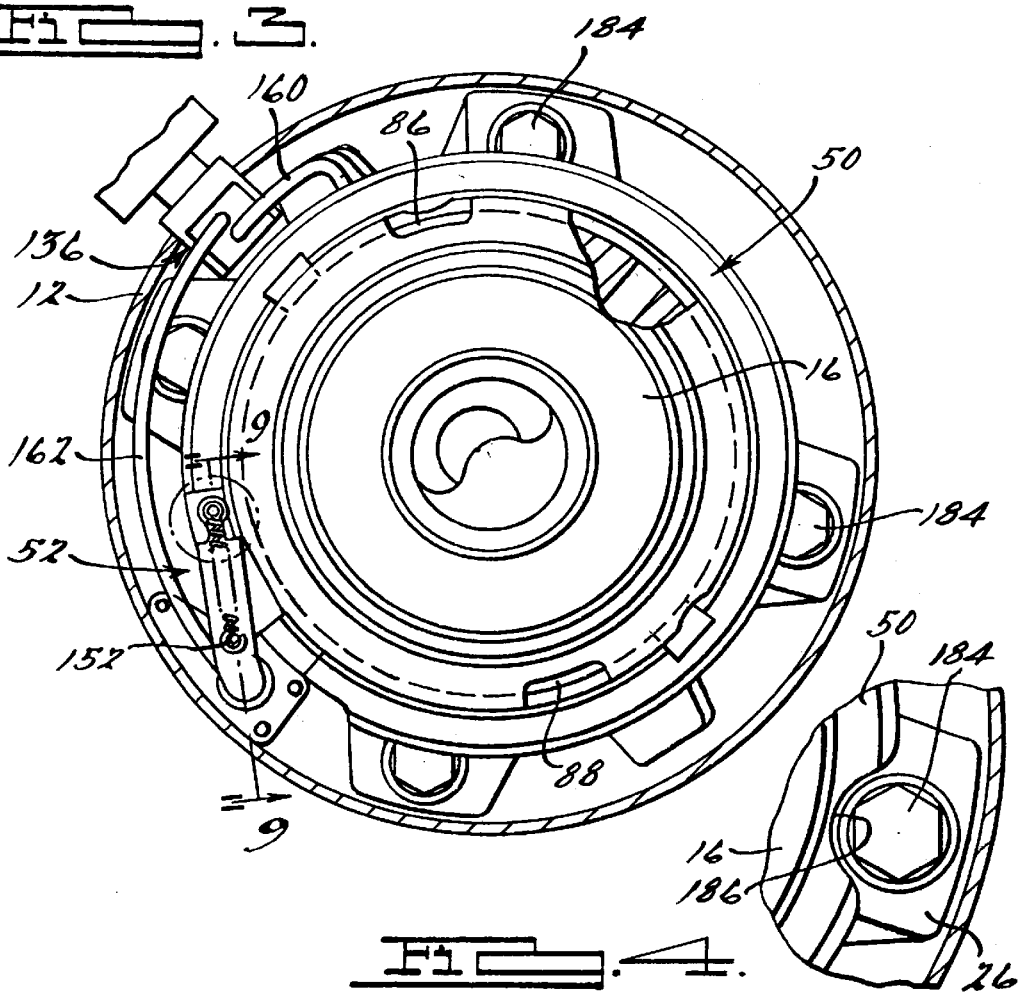
FIG. 4.

FIG. 12.
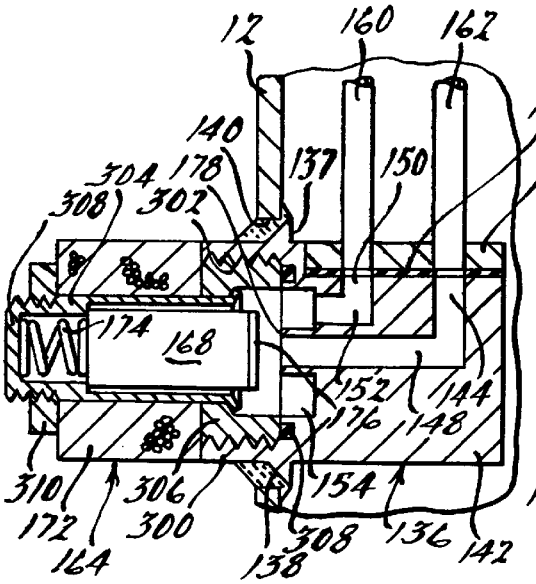
FIG. 13.
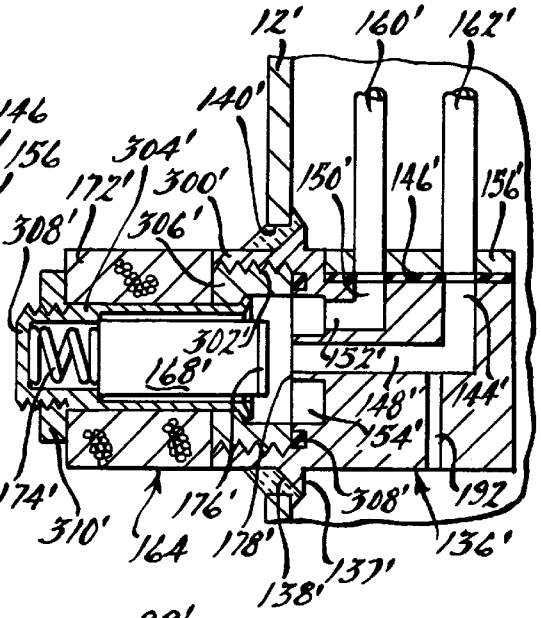
FIG. 14.
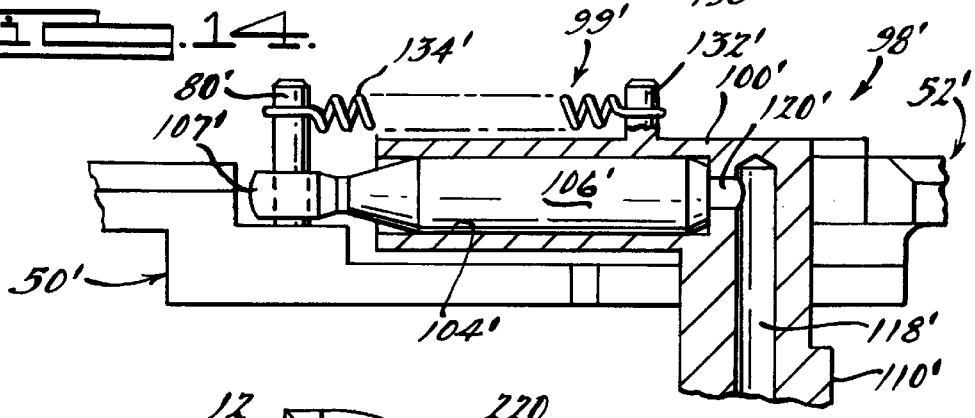
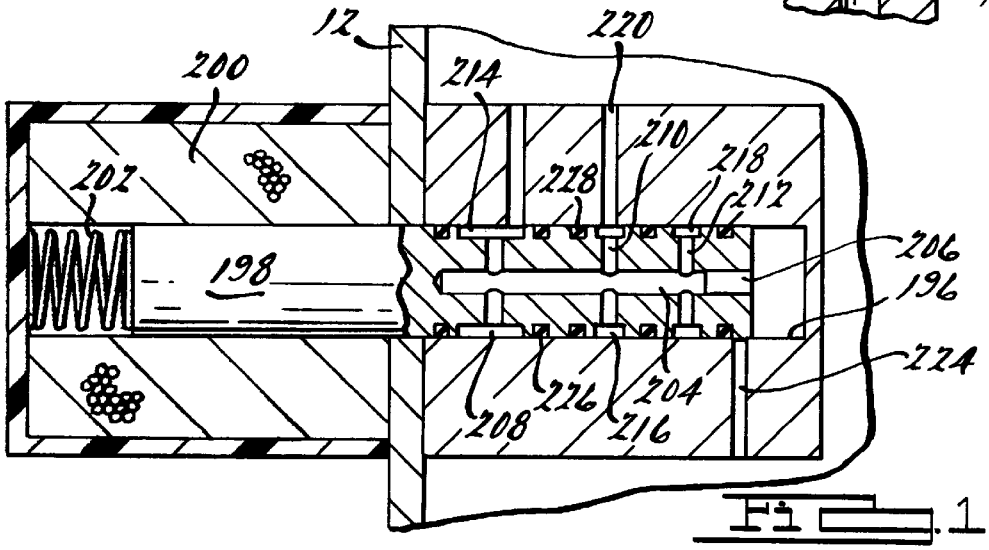
FIG. 15.

SCROLL MACHINE WITH CAPACITY MODULATION

BACKGROUND AND SUMMARY OF THE INVENTION

The present invention relates generally to scroll compressors and more specifically to capacity modulation systems of the delayed suction type for such compressors.

A wide variety of systems have been developed in order to accomplish capacity modulation most of which delay the initial sealing point of the moving fluid pockets defined by the scroll members. In one form, such systems commonly employ a pair of vent passages communicating between suction pressure and the outermost pair of moving fluid pockets. Typically these passages open into the moving fluid pockets at a position normally within 360° of the sealing point of the outer ends of the wraps. Some systems employ a separate valve member for each such vent passage which valves are intended to be operated simultaneously so as to ensure a pressure balance between the two fluid pockets. Other systems employ additional passages to place the two vent passages in fluid communication thereby enabling use of a single valve to control capacity modulation.

More recently a capacity modulation system for scroll compressors of the delayed suction type has been developed in which a valving ring is movably supported on the non-orbiting scroll member. An actuating piston is provided which operates to rotate the valving ring relative to the non-orbiting scroll member to thereby selectively open and close one or more vent passages which communicate with selective ones of the moving fluid pockets to thereby vent the pockets to suction. A scroll-type compressor incorporating this type of capacity modulation system is disclosed in U.S. Pat. No. 5,678,985 the disclosure of which is hereby incorporated by reference. In this capacity modulation system, the actuating piston is operated by fluid pressure controlled by a solenoid valve. In one version of this design, the solenoid valve and fluid pressure supply and vent lines are positioned externally of the compressor shell. While such an arrangement offers the advantages of ease of assembly as well as replaceability of the solenoid valve to accommodate different system operating voltages, the external piping is exposed and hence subject to potential damage during assembly/handling, shipment and/or installation.

In another version, the solenoid valve and actuating fluid supply lines are all located internally of the hermetic shell thus avoiding the potential for damage to the fluid supply lines. However, because the solenoid valve is not accessible once the hermetic shell is welded, varied available operating voltages for the solenoid can not be easily accommodated nor can the actuating coil of the solenoid valve be easily replaced in the event of failure thereof.

The present invention overcomes these disadvantages by providing a capacity modulation system utilizing the actuating ring approach in which all of the fluid supply lines and associated control valving are located within the hermetic shell but the actuating coil of the solenoid valve is mounted on the outer surface of the hermetic shell. Thus the fluid supply lines are protected from damage during shipment and installation of the compressor while the external mounting of the actuating coil enables the system to be easily adapted to most any available operating voltage. Further, the actuating coil may be easily replaced in the event of malfunction. Additionally, this system facilitates production lines testing of the capacity control modulation system prior to final welding of the hermetic shell via an appropriately designed fixturing system.

Additional advantages and features of the present invention will become apparent from the subsequent description and the appended claims taken in conjunction with the accompanying drawings.

BRIEF DESCRIPTION OF THE DRAWINGS

FIG. 2 is a fragmentary view of the compressor of FIG. 1 showing the valving ring in a closed or unmodulated position.

FIG. 3 is a plan view of the compressor shown in FIG. 1 with the top portion of the outer shell removed.

FIG. 4 is an enlarged view showing a portion of a modified valving ring.

FIG. 12 is an enlarged suction view of the solenoid valve assembly incorporated in the compressor of FIG. 1.

FIG. 13 is a view similar to that of FIG. 12 but showing a modified solenoid valve assembly.

FIG. 14 is a view similar to that of FIG. 9 but showing a modified actuating assembly adapted for use with the solenoid valve assembly of FIG. 13.

FIG. 15 is a view similar to that of FIGS. 12 and 13 but showing another embodiment of the solenoid valve assembly, all in accordance with the present invention.

DESCRIPTION OF THE PREFERRED EMBODIMENTS

Figure 1:
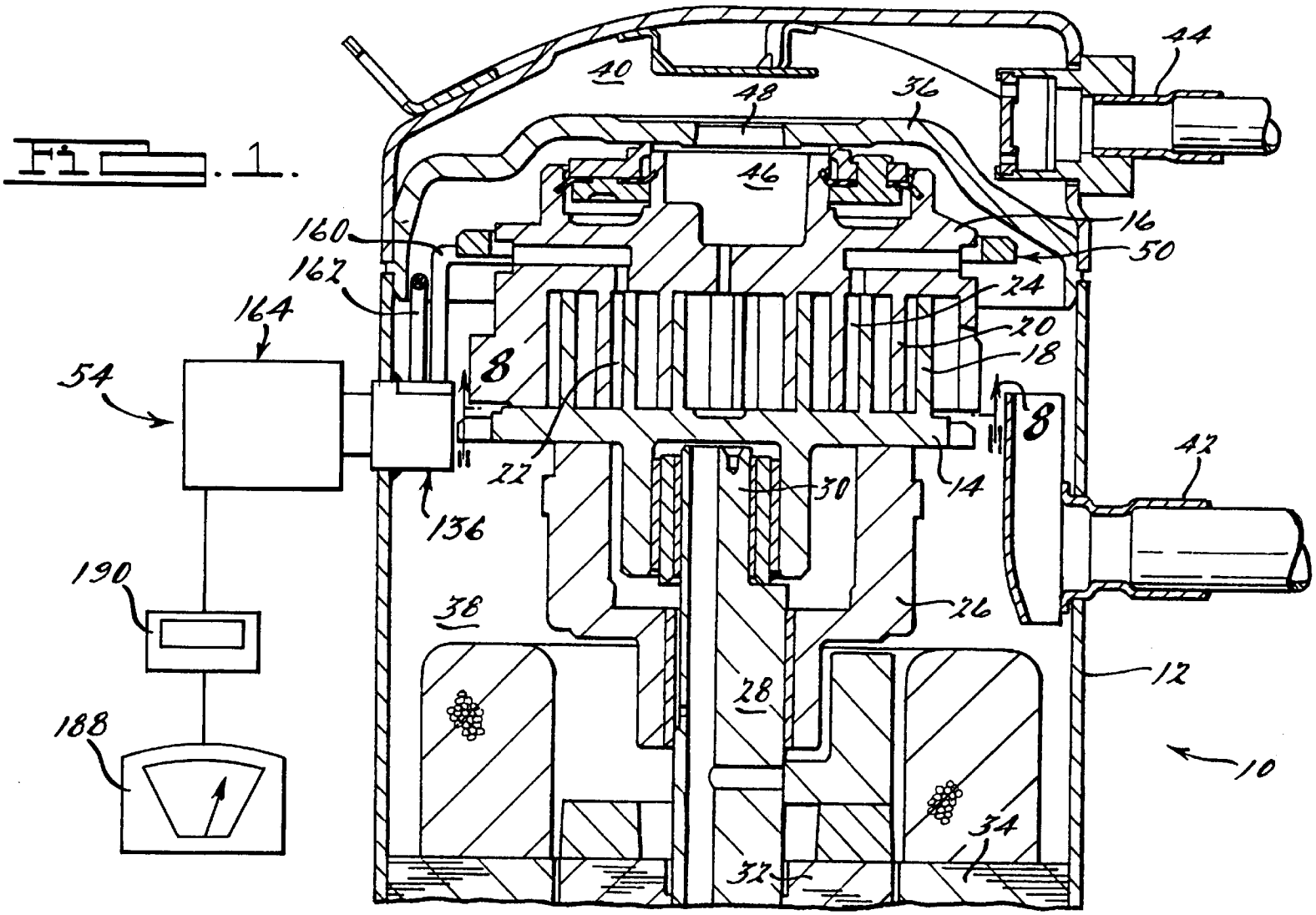
FIG. 1 is a fragmentary section view of a scroll-type compressor incorporating the capacity modulation system of the present invention.
Figure 5:
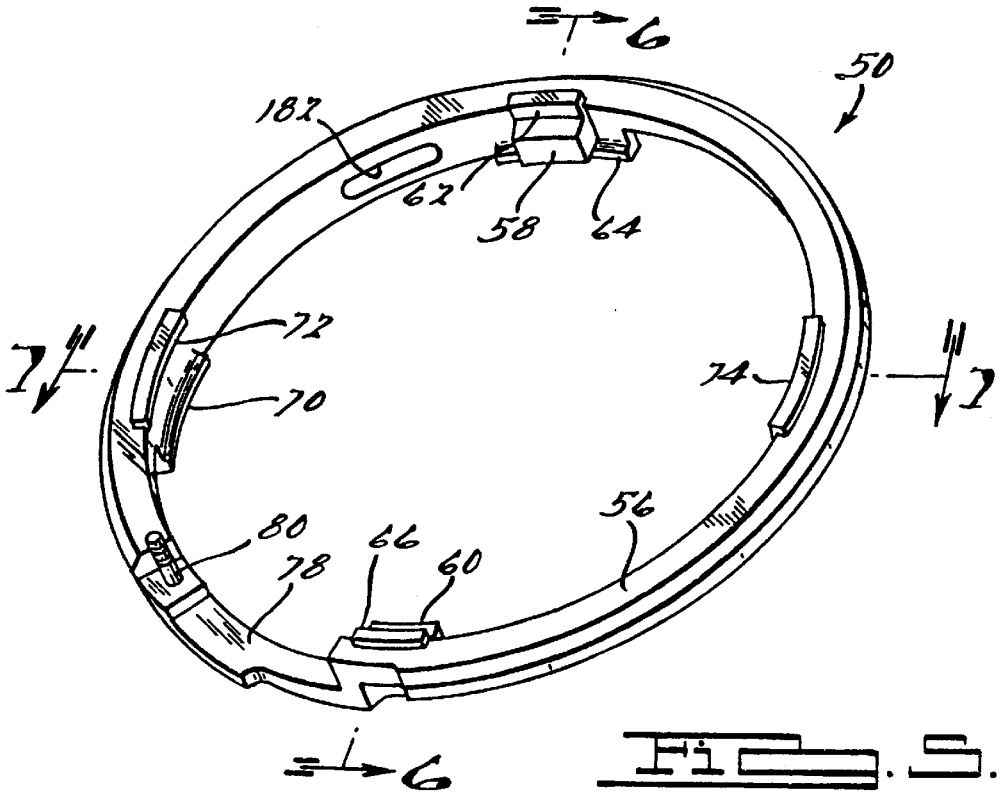
FIG. 5 is a perspective view of the valving ring incorporated in the compressor of FIG. 1.
Figure 6:
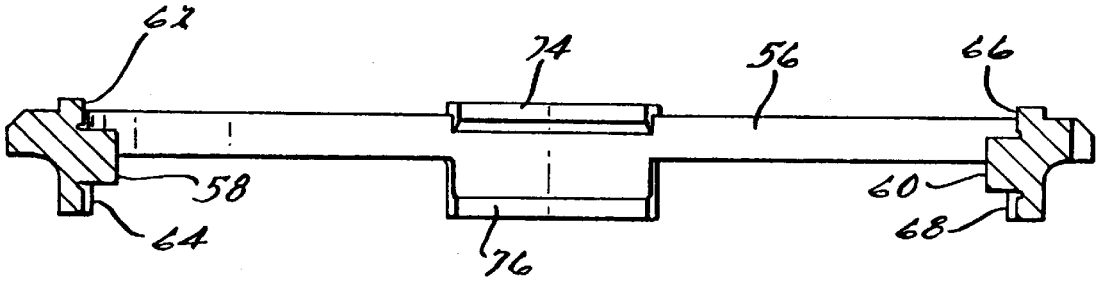
FIGS. 6 and 7 are section views of the valving ring of FIG. 4, the sections being taken along lines 6—6 and 7—7 respectively.
Figure 7:
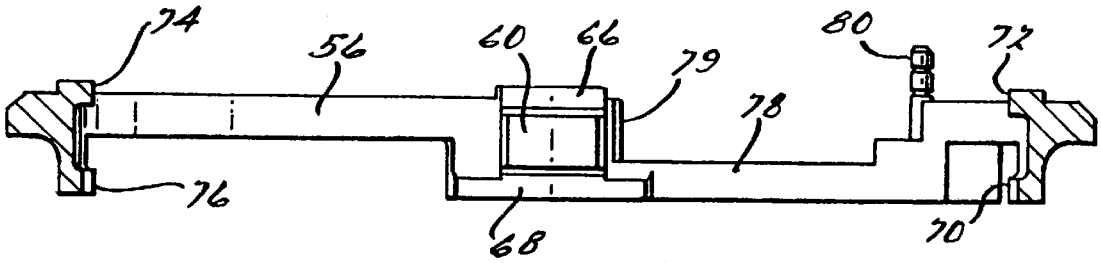
Figure 8:
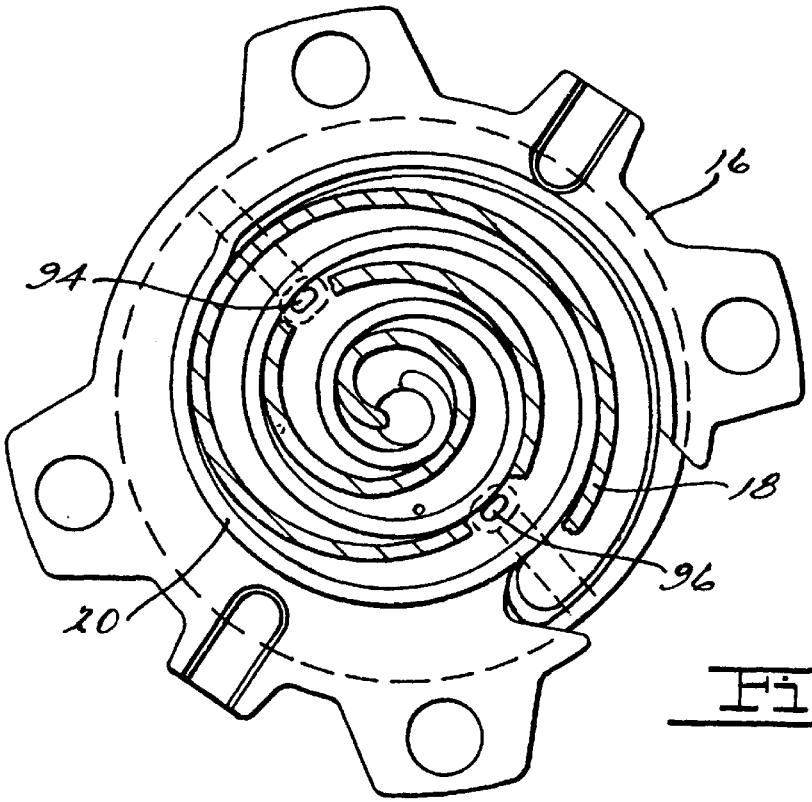
FIG. 8 is a fragmentary section view showing the scroll assembly forming a part of the compressor of FIG. 1, the section being taken along line 8—8 thereof.

Referring now to the drawings and in particular to FIG. 1, there is shown a hermetic refrigeration compressor of the scroll type indicated generally at 10 incorporating a capacity modulation system in accordance with the present invention.

Compressor 10 is generally of the type disclosed in U.S. Pat. No. 4,767,293 issued Aug. 30, 1988 and assigned to the same assignee as the present application the disclosure of which is hereby incorporated by reference. Compressor 10 includes a hermetically sealed outer shell 12 within which is disposed orbiting and non-orbiting scroll members 14 and 16 each of which include upstanding interleaved spiral wraps 18 and 20 which define moving fluid pockets 22, 24 which progressively decrease in size as they move inwardly from the outer periphery of the scroll members 14 and 16.

A main bearing housing 26 is provided which is supported by outer shell 12 and which in turn movably supports orbiting scroll member 14 for relative orbital movement with respect to non-orbiting scroll member 16. Non-orbiting scroll member 16 is supported by and secured to main bearing housing for limited axial movement with respect thereto in a suitable manner such as disclosed in U.S. Pat. No. 5,407,335 issued Apr. 18, 1995 and assigned to the same assignee as the present application, the disclosure of which is hereby incorporated by reference.

A drive shaft 28 is rotatably supported by main bearing housing 26 and includes an eccentric pin 30 at the upper end thereof drivingly connected to orbiting scroll member 14. A motor rotor 32 is secured to the lower end of drive shaft 28 and cooperates with a stator 34 supported by outer shell 12 to rotatably drive shaft 28.

Outer shell 12 includes a muffler plate 36 which divides the interior thereof into a first lower chamber 38 at substantially suction pressure and an upper chamber 40 at discharge pressure. A suction inlet 42 is provided opening into lower chamber 38 for supplying refrigerant for compression and a discharge outlet 44 is provided from discharge chamber 40 to direct compressed refrigerant to the refrigeration system.

As thus far described, scroll compressor 12 is typical of such scroll-type refrigeration compressors. In operation, suction gas directed to lower chamber 38 via suction inlet 42 is drawn into the moving fluid pockets 22 and 24 as orbiting scroll member 14 orbits with respect to non-orbiting scroll member 16. As the moving fluid pockets 22 and 24 move inwardly, this suction gas is compressed and subsequently discharged into discharge chamber 40 via a center discharge passage 46 in non-orbiting scroll member 16 and discharge opening 48 in muffler plate 36. Compressed refrigerant is then supplied to the refrigeration system via discharge outlet 44.

In selecting a refrigeration compressor for a particular application, one would normally choose a compressor having sufficient capacity to provide adequate refrigerant flow for the most adverse operating conditions to be anticipated for that application and may select a slightly larger capacity to provide an extra margin of safety. However, such "worst case" adverse conditions are rarely encountered during actual operation and thus this excess capacity of the compressor results in operation of the compressor under lightly loaded conditions for a high percentage of its operating time. Such operation results in reducing overall operating efficiency of the system. Accordingly, in order to improve the overall operating efficiency under generally encountered operating conditions while still enabling the refrigeration compressor to accommodate the "worst case" operating conditions, compressor 10 is provided with a capacity modulation system.

The capacity modulation system includes an annular valving ring 50 movably mounted on non-orbiting scroll member 16, an actuating assembly 52 supported within shell 12 and a control system 54 for controlling operation of the actuating assembly.

As best seen with reference to FIGS. 2 and 5 through 7, valving ring 50 comprises a generally circularly shaped main body portion 56 having a pair of substantially diametrically opposed radially inwardly extending protrusions 58 and 60 provided thereon of substantially identical predetermined axial and circumferential dimensions. Suitable substantially identical circumferentially extending guide surfaces 62, 64 and 66, 68 are provided adjacent axially opposite sides of protrusions 58 and 60, respectively. Additionally, two pairs of substantially identical circumferentially extending axially spaced guide surfaces 70, 72 and 74, 76 are provided on main body 56 being positioned in substantially diametrically opposed relationship to each other and spaced circumferentially approximately 90° from respective protrusions 58 and 60. As shown, guide surfaces 72 and 74 project radially inwardly slightly from main body 56 as do guide surfaces 62 and 66. Preferably, guide surfaces 72, 74 and 62, 66 are all axially aligned and lie along the periphery of a circle of a radius slightly less than the radius of main body 56. Similarly, guide surfaces 70 and 76 project radially inwardly slightly from main body 56 as do guide surfaces 64 and 68 with which they are preferably axially aligned. Also surfaces 70, 76 and 64, 68 lie along the periphery of a circle of a radius slightly less than the radius of main body 56 and preferably substantially equal to the radius of the circle along which surfaces 72, 74 and 62, 66 lie. Main body 56 also includes a circumferentially extending stepped portion 78 which includes an axially extending circumferentially facing stop surface 79 at one end. Step portion 78 is positioned between protrusion 60 and guide surfaces 70, 72. A pin member 80 is also provided extending axially upwardly adjacent one end of stepped portion 78. Valving ring 50 may be fabricated from a suitable metal such as aluminum or alternatively may be formed from a suitable polymeric composition and pin 80 may be either pressed into a suitable opening provided therein or integrally formed therewith.

As previously mentioned, valving ring 50 is designed to be movably mounted on non-orbiting scroll member 16. In order to accommodate valving ring 50, non-orbiting scroll member 16 includes a radially outwardly facing cylindrical sidewall portion 82 thereon having an annular groove 84 formed therein adjacent the upper end thereof. In order to enable valving ring 50 to be assembled to non-orbiting scroll member 16, a pair of diametrically opposed substantially identical radially inwardly extending notches 86 and 88 are provided in non-orbiting scroll member 16 each opening into groove 84 as best seen with reference to FIG. 3. Notches 86 and 88 have a circumferentially extending dimension slightly larger than the circumferential extent of protrusions 58 and 60 on valving ring 50.

Groove 84 is sized to movably accommodate protrusions 58 and 60 when valving ring is assembled thereto and notches 86 and 88 are sized to enable protrusions to be moved into groove 84. Additionally, cylindrical portion 82 will have a diameter such that guide surfaces 62, 64, 66, 68, 70, 72, 74 and 76 will slidingly support rotary movement of valving ring 50 with respect to non-orbiting scroll member 16.

Non-orbiting scroll member 16 also includes a pair of generally diametrically opposed radially extending passages 90 and 92 opening into the inner surface of groove 84 and extending generally radially inwardly through the end plate of non-orbiting scroll member 16. An axially extending passage 94 places the inner end of passage 90 in fluid communication with moving fluid pocket 22 while a second axially extending passage 96 places the inner end of passage 92 in fluid communication with moving fluid pocket 24. Preferably, passages 94 and 96 will be oval in shape so as to maximize the size of the opening thereof without having a width greater than the width of the wrap of the orbiting scroll member 14. Passage 94 is positioned adjacent an inner sidewall surface of scroll wrap 20 and passage 96 is positioned adjacent an outer sidewall surface of wrap 20. Alternatively passages 94 and 96 may be round if desired however the diameter thereof should be such that the opening does not extend to the radially inner side of the orbiting scroll member 14 as it passes thereover.

Figure 9:
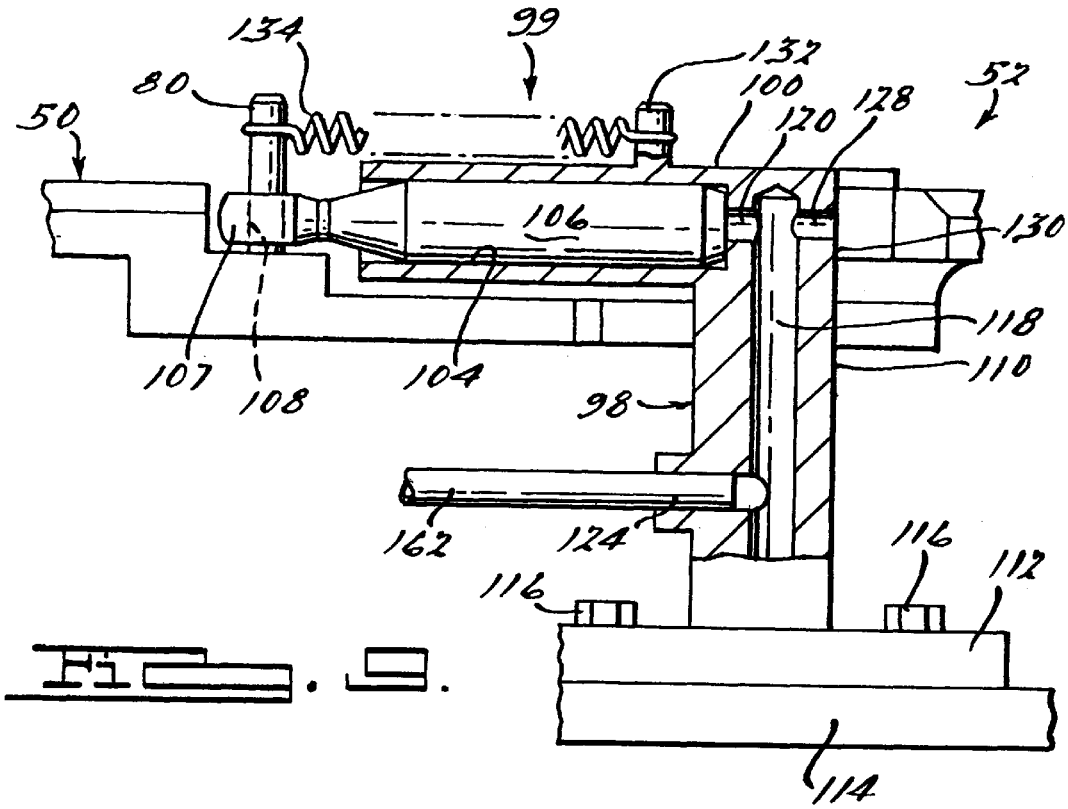
FIG. 9 is an enlarged detailed view of the actuating assembly incorporated in the compressor of FIG. 1.

As best seen with reference to FIG. 9, actuating assembly 52 includes a piston and cylinder assembly 98 and a return spring assembly 99. Piston and cylinder assembly 98 includes a housing 100 having a bore defining a cylinder 104 extending inwardly from one end thereof and within which a piston 106 is movably disposed. An outer end 107 of piston 106 projects axially outwardly from one end of housing 100 and includes an elongated or oval-shaped opening 108 therein adapted to receive pin 80 forming a part of valving ring 50. Elongated or oval opening 108 is designed to accommodate the arcuate movement of pin 80 relative to the linear movement of piston end 107 during operation. A depending portion 110 of housing 100 has secured thereto a suitably sized mounting flange 112 which is adapted to enable housing 100 to be secured to a suitable flange member 114 by bolts 116. Flange 114 is in turn suitably supported within outer shell 12 such as by bearing housing 26.

A passage 118 is provided in depending portion 110 extending upwardly from the lower end thereof and opening into a laterally extending passage 120 which in turn opens into the inner end of cylinder 104. A second laterally extending passage 124 provided in depending portion 110 opens outwardly through the sidewall thereof and communicates at its inner end with passage 118. A second relatively small laterally extending passage 128 extends from fluid passage 118 in the opposite direction of fluid passage 120 and opens outwardly through an end wall 130 of housing 100.

A pin member 132 is provided upstanding from housing 100 to which is connected one end of a return spring 134 the other end of which is connected to an extended portion of pin 80. Return spring 134 will be of such a length and strength as to urge ring 50 and piston 106 into the position shown in FIG. 9 when cylinder 104 is fully vented via passage 128.

Figure 10:
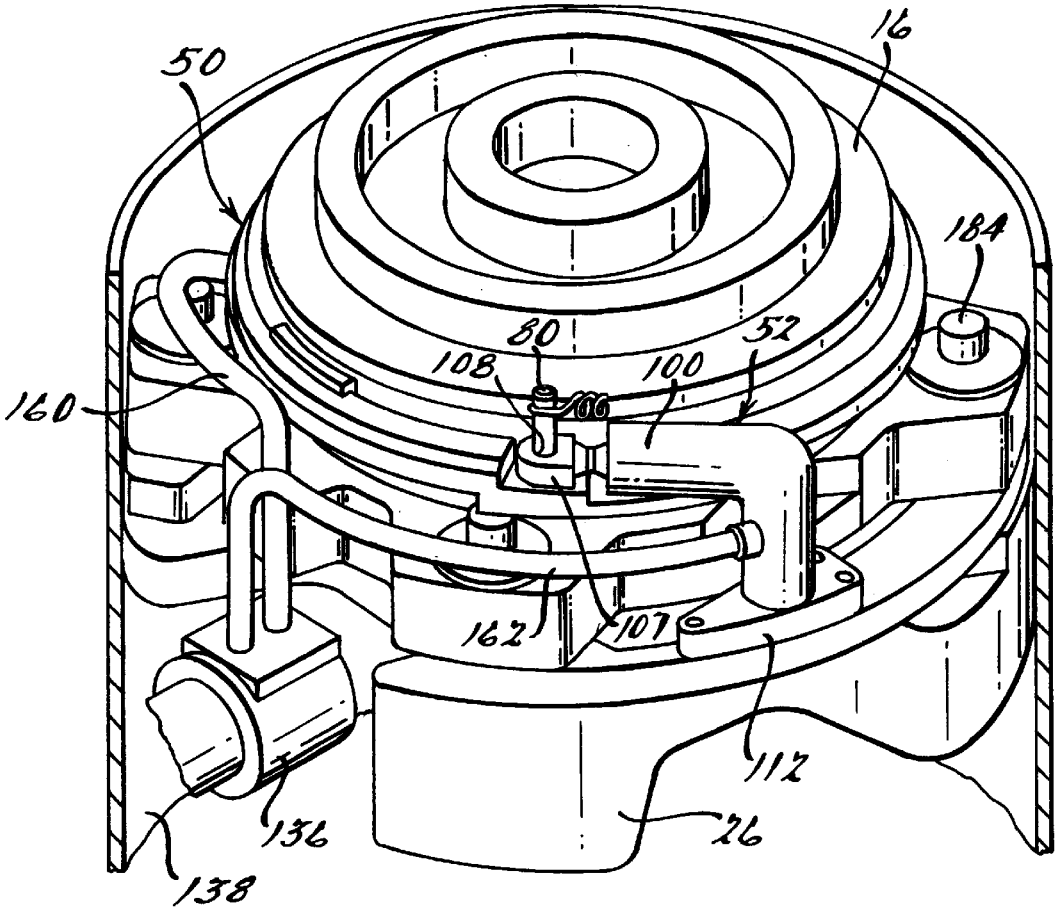
FIG. 10 is a perspective view of the compressor of FIG. 1 with portions of the outer shell broken away.

As best seen with reference to FIGS. 10 and 12, control system 54 includes a valve body 136 having a radially outwardly extending flange 137 including a conical surface 138 on one side thereof. Valve body 136 is inserted into opening 140 in outer shell 12 and positioned with conical surface 138 abutting the peripheral edge of opening 140 and then welded to shell 12 with cylindrical portion 300 projecting outwardly therefrom. Cylindrical portion 300 of valve body includes an enlarged diameter threaded bore 302 extending axially inwardly and opening into a recessed area 154.

Valve body 136 includes a housing 142 having a first passage 144 extending downwardly from a substantially flat upper surface 146 and intersecting a second laterally extending passage 148 which opens outwardly into the area of opening 140 in shell 12. A third passage 150 also extends downwardly from surface 146 and intersects a fourth laterally extending passage 152 which also opens outwardly into a recessed area 154 provided in the end portion of body 136.

A manifold 156 is sealingly secured to surface 146 by means of suitable fasteners and includes fittings for connection of one end of each of fluid lines 160 and 162 so as to place them in sealed fluid communication with respective passages 144 and 150.

A solenoid coil assembly 164 is designed to be sealingly secured to valve body 136 and includes an elongated tubular member 304 having a threaded fitting 306 sealingly secured to the open end thereof. Threaded fitting 306 is adapted to be threadedly received within bore 302 and sealed thereto by means of O-ring 308. A plunger 168 is movably disposed within tubular member 304 and is biased outwardly therefrom by spring 174 which bears against closed end 308 of tubular member 304. A valve member 176 is provided on the outer end of plunger 168 and cooperates with valve seat 178 to selectively close off passage 148. A solenoid coil 172 is positioned on tubular member 304 and secured thereto by means of nut 310 threaded on the outer end of tubular member 304.

Figure 11:
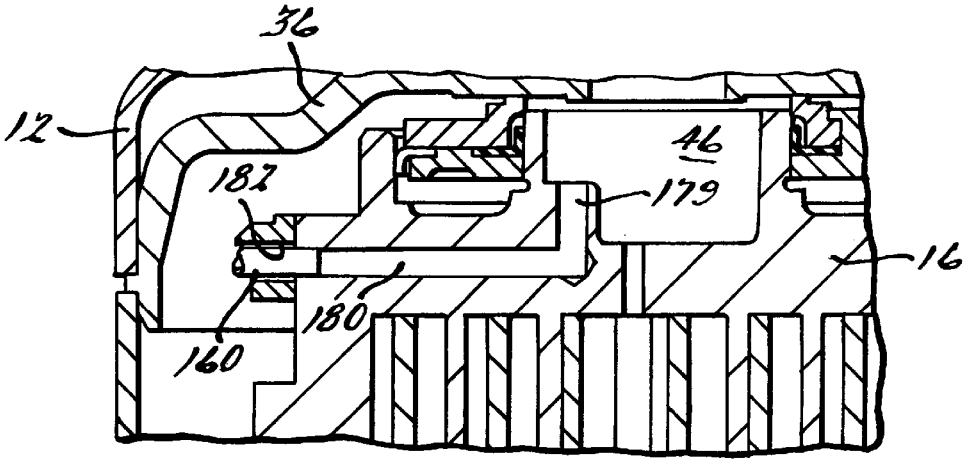
FIG. 11 is a fragmentary section view of the compressor of FIG. 1 showing the pressurized fluid supply passages provided in the non-orbiting scroll.

In order to supply pressurized fluid to actuating assembly 52, an axially extending passage 179 extends downwardly from discharge port 46 and connects to a generally radially extending passage 180 in non-orbiting scroll member 16. Passage 180 extends radially and opens outwardly through the circumferential sidewall of non-orbiting scroll 16 as best seen with reference to FIG. 11. The other end of fluid line 160 is sealingly connected to passage 180 whereby a supply of compressed fluid may be supplied from discharge port 46 to valve body 136. A circumferentially elongated opening 182 is provided in valving ring 50 suitably positioned so as to enable fluid line 160 to pass therethrough while accommodating the rotational movement of ring 50 with respect to non-orbiting scroll member 16.

In order to supply pressurized fluid from valve body 136 to actuating piston and cylinder assembly 98, fluid line 162 extends from valve body 136 and is connected to passage 124 provided in depending portion 110 of housing 100.

Valving ring 50 may be easily assembled to non-orbiting scroll member 16 by merely aligning protrusions 58 and 60 with respective notches 86 and 88 and moving protrusions 58 and 60 into annular groove 84. Thereafter valving ring 50 is rotated into the desired position with the axially upper and lower surfaces of protrusions 58 and 60 cooperating with guide surfaces 62, 64, 66, 68, 70, 72, 74 and 76 to movably support valving ring 50 on non-orbiting scroll member 50. Thereafter, housing 100 of actuating assembly 52 may be positioned on mounting flange 114 with piston end 107 receiving pin 80. One end of spring 134 may then be connected to pin 132. Thereafter, the other end of spring 134 may be connected to pin 80 thus completing the assembly process.

While non-orbiting scroll member 16 is typically secured to main bearing housing 26 by suitable bolts 184 prior to assembly of valving ring 50, it may in some cases be preferable to assemble this capacity modulation component to non-orbiting scroll member 16 prior to assembly of non-orbiting scroll member 16 to main bearing housing 26. This may be easily accomplished by merely providing a plurality of suitably positioned arcuate cutouts 186 along the periphery of valving ring 50 as shown in FIG. 4. These cutouts will afford access to securing bolts 184 with valving ring assembled to non-orbiting scroll member 16.

In operation, when system operating conditions as sensed by one or more sensors 188 indicate that full capacity of compressor is required, controller 190 will operate in response to a signal from sensor 188 to energize solenoid coil 172 of solenoid assembly 164 thereby causing plunger 168 to be moved out of engagement with valve seat 178 thereby placing passages 148 and 152 in fluid communication. Pressurized fluid at substantially discharge pressure will then be allowed to flow from discharge port 46 to cylinder 104 via passages 179, 180, fluid line 160, passages 150, 152, 148, 144, fluid line 162 and passages 124, 118 and 120. This fluid pressure will then cause piston 106 to move outwardly with respect to cylinder 104 thereby rotating valving ring so as to move protrusions 58 and 60 into sealing overlying relationship to passages 90 and 92. This will then prevent suction gas drawn into the moving fluid pockets defined by interengaging scroll members 14 and 16 from being exhausted or vented through passages 90 and 92.

When the load conditions change to the point that the full capacity of compressor 10 is not required, sensor 188 will provide a signal indicative thereof to controller 190 which in turn will deenergize coil 172 of solenoid assembly 164. Plunger 168 will then move outwardly from tubular member 304 under the biasing action of spring 176 thereby moving valve 176 into sealing engagement with seat 178 thus closing off passage 148 and the flow of pressurized fluid therethrough. It is noted that recess 154 will be in continuous fluid communication with discharge port 46 and hence continuously subject to discharge pressure. This discharge pressure will aid in biasing valve 176 into fluid tight sealing engagement with valve seat 178 as well as retaining same in such relationship.

The pressurized gas contained in cylinder 104 will bleed back into chamber 38 via vent passage 128 thereby enabling spring 134 to rotate valving ring 50 back to a position in which passages 90 and 92 are no longer closed off by protrusions 58 and 60. Spring 134 will also move piston 106 inwardly with respect to cylinder 104. In this position a portion of the suction gas being drawn into the moving fluid pockets defined by the interengaging scroll members 14 and 16 will be exhausted or vented through passages 90 and 92 until such time as the moving fluid pockets have moved out of communication with ports 94 and 96 thus reducing the volume of the suction gas being compressed and hence the capacity of the compressor. It should be noted that by arranging the modulation system such that compressor 10 is normally in a reduced capacity mode of operation (i.e., solenoid coil is deenergized and hence no fluid pressure is being supplied to the actuating piston cylinder assembly), this system offers the advantage that the compressor will be started in a reduced capacity mode thus requiring a lower starting torque. This enables use of a less costly lower starting torque motor if desired.

It should be noted that the speed with which the valving ring may be moved between the modulated position of FIG. 1 and the unmodulated position of FIG. 2 will be directly related to the relative size of vent passage 128 and the supply lines. In other words, because passage 128 is continuously open to chamber 38 which is at suction pressure, a portion of the pressurized fluid flowing from discharge port 46 will be continuously vented to suction pressure. The volume of this fluid will be controlled by the relative sizing of passage 128. However, as passage 128 is reduced in size, the time required to vent cylinder 104 will increase thus increasing the time required to switch from reduced capacity to full capacity.

While the above embodiment has been described utilizing a passage 128 provided in housing 100 to vent actuating pressure from cylinder 104 to thereby enable compressor 10 to return to reduced capacity, it is also possible to delete passage 128 and incorporate a vent passage in the valve body 136 in place thereof. Such an embodiment is shown in FIGS. 13 and 14. FIG. 13 shows a modified valve body 136' incorporating a vent passage 192 which will operate to continuously vent passage 144' to suction pressure and hence allow cylinder 104 to vent to suction via line 162. FIG. 14 in turn shows a modified piston and cylinder assembly 98' in which vent passage 128 has been deleted. The operation and function of valve body 136' and piston cylinder assembly 98' will otherwise be substantially identical to that disclosed above. Accordingly, corresponding portions of valve bodies 136 and 136' piston and cylinder assemblies 98 and 98' are substantially identical and have each been indicated by the same reference numbers primed.

While the above embodiments provide efficient relatively low cost arrangements for capacity modulation, it is also possible to utilize a three way solenoid valve in which the venting of cylinder 104 is also controlled by valving. Such an arrangement is illustrated and will be described with reference to FIG. 15. In this embodiment, valve body 194 is secured to shell 12' in the same manner as described above and includes an elongated central bore 196 within which is movably disposed a spool valve 198. Spool valve 198 extends outwardly through shell 12 into solenoid coil 200 and is adapted to be moved longitudinally outwardly from valve body 194 upon energization of solenoid coil 200. A coil spring 202 operates to bias spool valve 198 into valve body 194 when coil 200 is not energized.

Spool valve 198 includes an elongated axially extending central passage 204 the inner end of which is plugged via plug 206. Three groups of generally radially extending axially spaced passages 208, 210, 212 are provided each group consisting of one or more such passages which extend outwardly from central passage 204 with each group opening into axially spaced annular grooves 214, 216 and 28 respectively. Valve body 194 in turn is provided with a first high pressure supply passage 220 which opens into bore 196 and is adapted to be connected to fluid line 160 to supply compressed fluid to valve body 194. A second passage 222 in valve body also opens into bore 196 and is adapted to be connected to fluid line 162 at its outer end to place bore 196 in fluid communication with cylinder 104. A vent passage 224 is also provided in valve body 194 having one end opening into bore 196 with the other end opening into lower chamber 38 of shell 12.

In operation, when solenoid coil is deenergized, spool valve 198 will be in a position such that annular groove 214 will be in open communication with passage 222 and annular groove 218 will be in open communication with vent passage 224 thereby continuously venting cylinder 104. At this time, spool valve 198 will be positioned such that annular seals 226 and 228 will lie on axially opposite sides of passage 220 thereby preventing flow of compressed fluid from discharge port 46. When it is desired to actuate the capacity modulation system to increase the capacity of compressor 10, solenoid coil 200 will be energized thereby causing spool valve 198 to move outwardly from valve body 194. This will result in annular groove 218 moving out of fluid communication with vent passage 224 while annular groove 216 is moved into open communication with high pressure supply passage 220. As passage 222 will remain in fluid communication with annular groove 214 pressurized fluid from passage 220 will be supplied to cylinder 104 via passages 210 and 208 in spool valve 198. Additional suitable axially spaced annular seals will also be provided on spool valve 198 to ensure a sealing relationship between spool valve 198 and bore 196.

The capacity modulation system of the present invention is well suited to enable testing thereof before final welding of the outer shell. In order to accomplish this test, it is only necessary to provide a supply of pressurized fluid to the discharge port 46 and appropriate actuating power to the solenoid coil. Cycling of the solenoid coil will then operate to effect the necessary rotary movement of valving ring thereby providing assurance that all the internal operating components have been properly assembled. The pressurized fluid may be supplied either by operating the compressor to generate same or from an appropriate external source.

While it will be apparent that the preferred embodiments of the invention disclosed are well calculated to provide the advantages and features above stated, it will be appreciated that the invention is susceptible to modification, variation and change without departing from the proper scope or fair meaning of the subjoined claims.

We claim:

1. A capacity modulated compressor comprising:

a hermetic shell defining a substantially enclosed space;

a compressing mechanism supported within said shell in said substantially enclosed space, said compressing mechanism including a first scroll member having a first end plate and a first spiral wrap upstanding therefrom, a second scroll member having a second end plate and a second spiral wrap upstanding therefrom, said first and second spiral wraps being interleaved to define moving fluid pockets which decrease in size as they move from a radially outer position to a radially inner position in response to relative orbital movement between said first and second scroll members to thereby compress a fluid;

a modulation system for changing the capacity of said compressing mechanism from full capacity to a reduced capacity, said modulation system including a vent for placing at least one of said moving fluid pockets in fluid communication with a low pressure area within said hermetic shell, and a fluid pressure actuated annular ring valve for selectively opening and closing said vent, said modulation system further including a first portion secured to an inner surface of said shell within said substantially enclosed space, a solenoid coil secured on an outer surface of said shell and an operating plunger extending between said solenoid coil and said first portion, movement of said plunger in response to energization of said solenoid coil being operative to utilize said compressed fluid to activate said annular ring valve to open and close said vent to thereby effect a change in the capacity of said compressing mechanism between full capacity and reduced capacity.

2. A capacity modulated compressor as set forth in claim 1 wherein said first portion comprises a valve body.

3. A capacity modulated compressor as set forth in claim 2 wherein said modulation system includes a fluid pressure actuator for changing the capacity of said compressor, said valve body and said solenoid cooperating to selectively supply said compressed fluid to said actuator.

4. A capacity modulated compressor as set forth in claim 3 wherein said modulation system includes a first fluid line for supplying compressed fluid from said compressing mechanism to said valve body and a second fluid line for supplying said compressed fluid from said valve body to said actuator.

5. A capacity modulated compressor as set forth in claim 2 wherein said plunger includes a valve operative to open and close a fluid passage in said valve body.

6. A capacity modulated scroll-type compressor comprising:

a hermetic shell;

a first scroll member having a first end plate and a first spiral wrap upstanding therefrom;

a second scroll member having a second end plate and a second spiral wrap upstanding therefrom, said first and second scroll members being supported within said hermetic shell and interleaved to define at least two moving fluid pockets which decrease in size as they move from a radially outer position to a radially inner position in response to relative orbital movement between said first and second scroll members;

a vent for placing at least one of said moving fluid pockets in fluid communication with a lower pressure area within said hermetic shell;

a fluid pressure actuated valve for selectively opening and closing said vent to thereby change the capacity of said compressor;

a pressurized fluid supply passage in one of said first and second scrolls for supplying fluid compressed by said first and second scroll members to said fluid pressure actuated valve; and a control valve operative to control flow of compressed fluid through said pressurized fluid supply passage to said fluid pressure actuated valve.

7. A capacity modulated scroll-type compressor as set forth in claim 6 wherein said control valve is a solenoid operated valve.

8. A capacity modulated scroll-type compressor as set forth in claim 7 wherein said solenoid operated valve includes a valve body disposed within said hermetic shell and an actuating coil disposed outside said hermetic shell.

9. A capacity modulated scroll-type compressor as set forth in claim 8 wherein said actuating coil includes a plunger having a valve member, said valve member cooperating with said valve body to selectively control flow of compressed fluid through said pressurized fluid supply passage.

10. A capacity modulated scroll-type compressor as set forth in claim 6 wherein said vent includes a first fluid passage communicating between a first of said two moving fluid pockets and an area at substantially suction pressure, a second fluid passage communicating between a second of said two moving fluid pockets and an area at substantially suction pressure and said fluid pressure actuated valve operates to substantially simultaneously open and close said first and second fluid passages.

11. A capacity modulated scroll-type compressor as set forth in claim 10 wherein said fluid pressure actuated valve is an annular ring.

12. A capacity modulated scroll-type compressor as set forth in claim 10 wherein said fluid pressure actuated valve includes a cylinder and a piston movably disposed within said cylinder, said compressed fluid being operative to effect movement of said piston to thereby actuate said valve.

13. A capacity modulated scroll-type compressor as set forth in claim 6 wherein said one of said first and second scroll members includes a discharge port, said pressurized fluid supply passage opening into said discharge port.

14. A capacity modulated scroll-type compressor as set forth in claim 13 further comprising a first fluid line having one end connected to said pressurized fluid supply passage and the other end connected to said control valve.

15. A capacity modulated scroll-type compressor as set forth in claim 14 wherein a second fluid line connected between said control valve and said fluid pressure actuated valve.

16. A capacity modulated scroll-type compressor as set forth in claim 15 wherein said control valve includes a valve body disposed within said hermetic shell, a solenoid coil disposed outside said hermetic shell, and a plunger including a valve member cooperating with said valve body in response to selective energization of said solenoid coil to control fluid flow through said first and second fluid lines.

17. A capacity modulated scroll-type compressor as set forth in claim 16 wherein said valve body is secured to an inner surface of said hermetic shell and said plunger extends through an opening provided in said hermetic shell.

18. A capacity modulated scroll-type compressor as set forth in claim 15 wherein said valve body includes a vent passage, said valve member operates to selectively place said second fluid line in communication with said vent passage.

19. A capacity modulated scroll-type compressor as set forth in claim 15 wherein said valve body includes a vent passage, said second fluid line being in continuous fluid communication with said vent passage.

20. A scroll-type refrigeration compressor having a capacity modulation system comprising:

a hermetic shell;

a first scroll member within said shell and having a first end plate and a first spiral wrap upstanding therefrom, said first scroll member including a discharge port;

a second scroll member within said shell and having a second end plate and a second spiral wrap upstanding therefrom, said first and second spiral wraps being interleaved to define at least two moving fluid pockets which decrease in size as they move from a radially outer position to a radially inner position in response to relative orbital movement between said scroll members;

a stationary body within said shell for supporting said second scroll member for orbital movement with respect to said first scroll member, said first scroll member being supportingly secured to said stationary body;

a first fluid passage provided in said first scroll member and extending generally radially from a first fluid pocket and opening outwardly along an outer peripheral surface of said first scroll member;

a second fluid passage provided on said first scroll member and extending generally radially from a second fluid pocket and opening outwardly along an outer peripheral surface of said first scroll member, in circumferentially spaced relationship from said first passage;

an annular valve ring rotatably supported on said peripheral surface in radially spaced overlying relationship to said openings of said first and second passages, said valve ring including first and second portions movable into and out of overlying relationship with respect to said first and second openings respectively to close and open said passages;

an actuating assembly supported within said shell, said actuating assembly being operable to effect rotary movement of said valve ring with respect to said first scroll member to thereby move said portions into and out of overlying relationship with said openings whereby the capacity of said compressor may be modulated;

a third passage provided in said first scroll member and extending generally radially outwardly from said discharge port and opening radially outwardly along an outer surface of said first scroll member;

a valve body secured to an inner surface of said shell;

a first fluid line for supplying compressed fluid from said third passage to said valve body;

a second fluid line for supplying said compressed fluid from said valve body to said actuating assembly; and a solenoid coil supported on the outer surface of said shell, said solenoid coil including a valve operative in response to energization of said solenoid coil to control fluid flow through said valve body.

21. A scroll-type refrigeration compressor as set forth in claim 20 wherein said valve body includes a vent passage in open communication with said second fluid line.

22. A scroll-type refrigeration compressor as set forth in claim 20 wherein said valve operates to selectively place said second fluid line in communication with said first fluid line in a first position and to place said second fluid line in communication with a vent passage provided in said valve body when in a second position.

* * * * *

UNITED STATES PATENT AND TRADEMARK OFFICE

CERTIFICATE OF CORRECTION

PATENT NO. : 6,120,255

DATED : September 19, 2000

INVENTOR(S) : Stanley P. Schumann et al

It is certified that error appears in the above-identified patent and that said Letters Patent is hereby corrected as shown below:

Column 10, line 64, "15" should be -- 17 --.

Column 11, line 2, "15" should be -- 17 --.

Signed and Sealed this

Fifteenth Day of May, 2001

*Attest:*

Nicholas P. Godici

NICHOLAS P. GODICI

*Attesting Officer*

*Acting Director of the United States Patent and Trademark Office*